US012507766B2

(12) United States Patent
Yang et al.

(10) Patent No.: US 12,507,766 B2
(45) Date of Patent: Dec. 30, 2025

(54) STRAP MEMBER AND STRAP ASSEMBLY THEREWITH

(71) Applicant: Universal Trim Supply Co., Ltd., New Taipei (TW)

(72) Inventors: Shih-Sheng Yang, Taipei (TW); Chih-Hung Chen, New Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 107 days.

(21) Appl. No.: 18/376,448

(22) Filed: Oct. 4, 2023

(65) Prior Publication Data

US 2025/0040666 A1 Feb. 6, 2025

(30) Foreign Application Priority Data

Aug. 3, 2023 (CN) ..... 202322076348.6

(51) Int. Cl.
*A44B 18/00* (2006.01)

(52) U.S. Cl.
CPC ..... *A44B 18/0015* (2013.01); *A44B 18/0011* (2013.01); *A44B 18/0049* (2013.01); *A44B 18/0073* (2013.01)

(58) Field of Classification Search
CPC ..... A44B 18/0015; A44B 18/0011; A44B 18/0049; A44B 18/0073; A44B 18/0046
See application file for complete search history.

(56) References Cited

U.S. PATENT DOCUMENTS

| | | | | |
|---|---|---|---|---|
| 4,183,121 | A * | 1/1980 | Cousins | A44B 13/0052 24/DIG. 43 |
| 2005/0198790 | A1* | 9/2005 | Duffy | A44B 18/0049 24/452 |
| 2015/0068013 | A1* | 3/2015 | Galu, Jr. | A44B 18/008 24/449 |

* cited by examiner

*Primary Examiner* — Jason W San
*Assistant Examiner* — Rowland Do
(74) *Attorney, Agent, or Firm* — Winston Hsu

(57) ABSTRACT

A strap member is provided and includes a strap body and a plurality of hook portions. The strap member includes a first surface and a second surface. Each of the plurality of hook portions includes a hole structure and at least one hook structure. The hole structure penetrates through the strap body and includes a first opening formed on the first surface and a second opening formed on the second surface. The at least one hook structure is at least partially disposed inside the hole structure and connected to a hole wall of the hole structure. Besides, a related strap assembly is also provided.

6 Claims, 11 Drawing Sheets

STRAP MEMBER AND STRAP ASSEMBLY THEREWITH

BACKGROUND OF THE INVENTION

1. Field of the Invention

The present invention relates to a strap member and a strap assembly therewith, and more specifically, to a strap member with a thin thickness and a strap assembly therewith.

2. Description of the Prior Art

A strap assembly, e.g., a velcro strap assembly, including a male strap and a female strap adhesively bound with each other, is widely used. The male strap usually includes a male surface and a plurality of hook structures disposed on the male surface. The female strap usually includes a female surface and a plurality of loop structures disposed on the female surface. The male surface of the male strap and the female surface of the female strap can be adhesively bound with each other by engagement of the plurality of hook structures and the plurality of loop structures.

However, the conventional male strap has a thick thickness due to a protruding configuration of the hook structures disposed on the male surface. Therefore, the conventional male strap is not suitable for being attached on a cloth, a bag or a shoe by sewing.

SUMMARY OF THE INVENTION

It is an objective of the present invention to provide a strap member with a thin thickness and a strap assembly therewith for solving the aforementioned problems.

In order to achieve the aforementioned objective, the present invention discloses a strap member. The strap member includes a strap body and a plurality of hook portions. The strap member includes a first surface and a second surface. Each of the plurality of hook portions includes a hole structure and at least one hook structure. The hole structure penetrates through the strap body and includes a first opening formed on the first surface and a second opening formed on the second surface. The at least one hook structure is at least partially disposed inside the hole structure and connected to a hole wall of the hole structure.

According to an embodiment of the present invention, each of the plurality of hook portions further includes at least one beam disposed on the second surface of the strap body and extending along the second surface of the strap body. At least one end of the at least one beam stretches into the corresponding hole structure, and the at least one hook structure is formed on the at least one end of the at least one beam.

According to an embodiment of the present invention, each of the plurality of hook portions further includes an island structure and at least one connecting rib. The island structure is disposed on a middle part of the hole structure, and the at least one connecting rib is connected to the island structure and the hole wall of the hole structure.

According to an embodiment of the present invention, each of the plurality of hook portions further includes at least one auxiliary hook structure formed on the at least one connecting rib.

According to an embodiment of the present invention, each of the plurality of hook portions further includes at least one auxiliary beam disposed on the second surface of the strap body and extending along the second surface of the strap body. At least one end of the at least one auxiliary beam stretches into the corresponding hole structure, and the at least one connecting rib is formed on the at least one end of the at least one auxiliary beam.

According to an embodiment of the present invention, the plurality of hook portions includes a first hook portion and a second hook portion. The first hook portion includes at least one first auxiliary beam, and the second hook portion includes at least one second auxiliary beam connected to the at least one first auxiliary beam.

According to an embodiment of the present invention, the at least one hook structure is a conical column and includes a first end and a second end. A diameter of the at least one hook structure gradually decreases from the second end of the at least one hook structure toward the first end of the at least one hook structure. A longitudinal direction of the at least one hook structure is perpendicular to the strap body. The second end of the at least one hook structure is connected to the hole wall, and the first end of the at least one hook structure is located adjacent to the first surface of the strap body.

According to an embodiment of the present invention, the hole structure is a circular hole structure.

According to an embodiment of the present invention, the at least one hook structure includes a plurality of hook structures arranged symmetrically relative to a center of the hole structure.

In order to achieve the aforementioned objective, the present invention further discloses a strap assembly. The strap assembly includes one of the aforementioned strap members and a cooperating strap member. The cooperating strap member includes a cooperating surface and a plurality of loop structures. The plurality of loop structures are disposed on the cooperating surface and configured to detachably engage with the hook structures of the plurality of hook portions through the second openings to bind the second surface of the strap body and the cooperating surface of the cooperating strap member together.

In summary, in the present invention, the hook structure does not protrude out of the hole structure penetrating through the strap body beyond the first surface of the strap body, and therefore, the strap member has a thin thickness and is suitable for being attached on a cloth, a bag or a shoe by sewing.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "front", "rear", "upper", "lower", etc., is used with reference to the orientation of the Figure(s) being described. The members of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Furthermore, the ordinal number terminology, such as first, second and third, can be used to describe various elements, and the elements are not limited by definition of the ordinal number terminology. For example, the mere usage of the ordinal numbers "first" and "second" before the term "device" (1) does not indicate that either device comes before or after any other in order or location; (2) does not indicate that either device occurs or acts before or after any other in time; and (3) does not indicate that either device ranks above or below any other, as in importance or quality. The mere usage of ordinal numbers does not define a numerical limit to the features identified with the ordinal numbers. For example, the mere usage of the ordinal numbers "first" and "second" before the term "device" does not indicate that there are exactly two devices. The term "plurality" means "two or more", unless expressly specified otherwise.

Figure 1A:
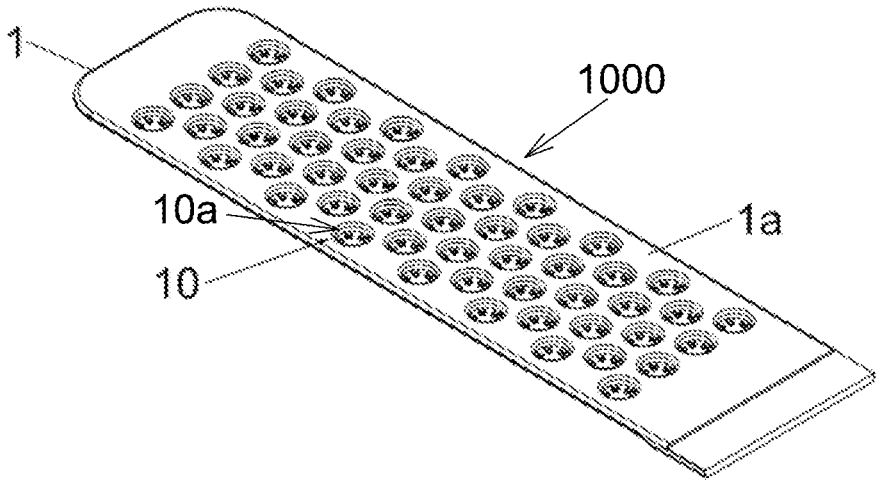
FIG. 1A is a perspective diagram of a strap member according to a first embodiment of the present invention.
Figure 1B:
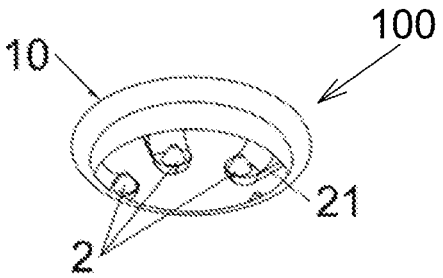
FIG. 1B is a diagram of a hook portion of the strap member shown in FIG. 1A according to the first embodiment of the present invention.
Figure 2:
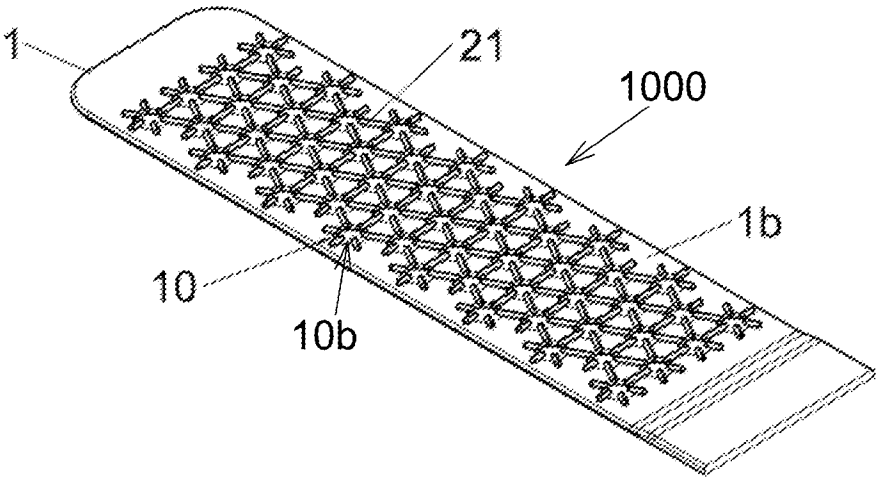
FIG. 2 is another perspective diagram of the strap member according to the first embodiment of the present invention.

As shown in FIG. 1A, FIG. 1B and FIG. 2, in a first embodiment, a strap member 1000 includes a strap body 1 and a plurality of hook portions 100. The strap body 1 includes a first surface 1*a*, e.g., a front surface, and a second surface 1*b*, e.g., a rear surface, opposite to the first surface 1*a*. Each hook portion 100 includes a hole structure 10 and at least one hook structure 2. Each hole structure 10 penetrates through the strap body 1 and includes a first opening 10*a* formed on the first surface 1*a* and a second opening 10*b* formed on the second surface 1*b*. Each hook structure 2 is at least partially disposed inside the corresponding hole structure 10 and connected to a hole wall of the corresponding hole structure 10.

As shown in FIG. 3A to FIG. 3F, each hook portion 100 further includes at least one beam 21 disposed on the second surface 1*b* of the strap body 1 and extending along the second surface 1*b* of the strap body 1. In other words, a longitudinal direction of each beam 21 is substantially parallel to the second surface 1*b* of the strap body 1, and a distal beam surface of each beam 21 is connected to the second surface 1*b* of the strap body 1.

At least one end of each beam 21 stretches into the corresponding hole structure 10, and each hook structure 2 is formed on the corresponding end of the corresponding beam 21 stretching into the corresponding hole structure 10.

Figure 3A:
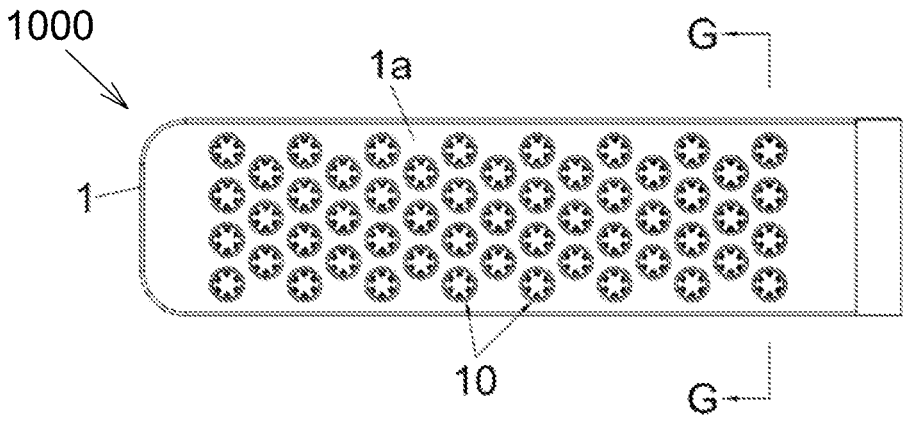
FIG. 3A to FIG. 3C are diagrams of the strap member at different views according to the first embodiment of the present invention.
Figure 3B:
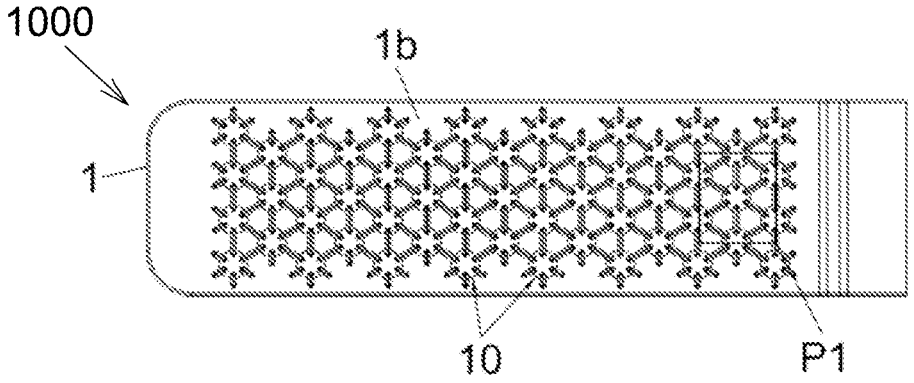
Figure 3C:
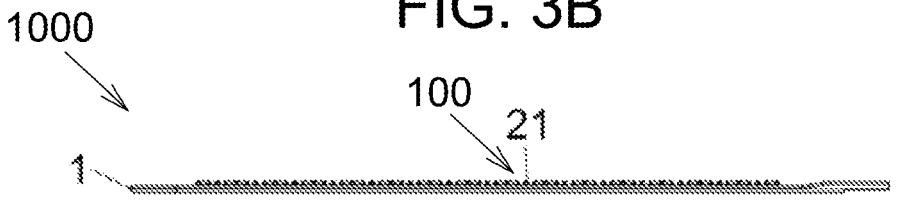
Figure 3D:
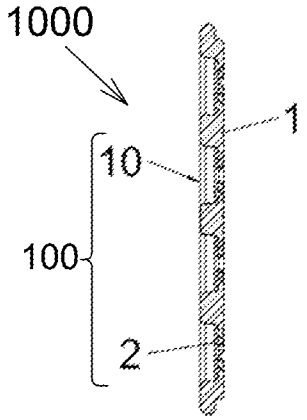
FIG. 3D is a sectional diagram of the strap member along a G-G line shown in FIG. 3A according to the first embodiment of the present invention.
Figure 3E:
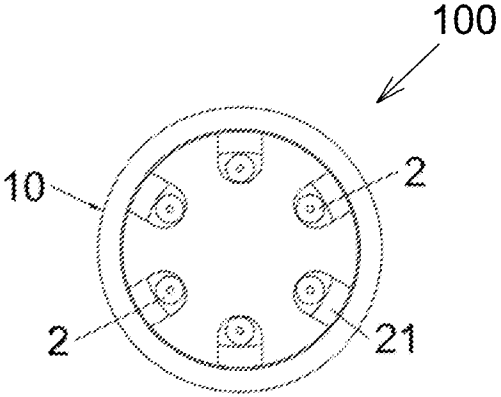
FIG. 3E is a diagram of the hook portion of the strap member shown in FIG. 3A according to the first embodiment of the present invention.
Figure 3F:
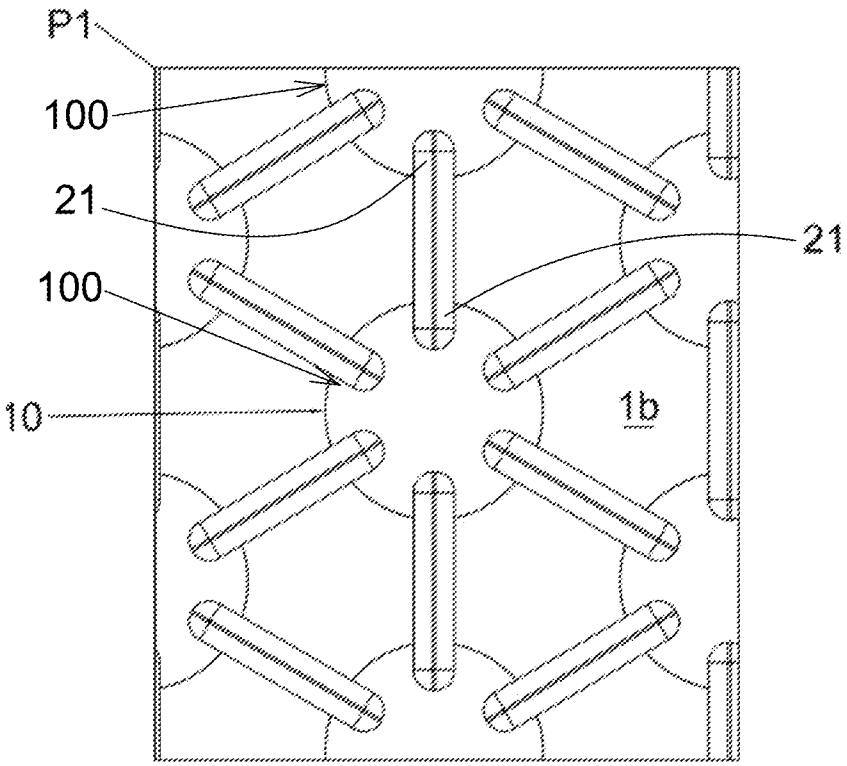
FIG. 3F is an enlarged diagram of a P1 portion of the strap member shown in FIG. 3B according to the first embodiment of the present invention.

Specifically, as shown in FIG. 3F, each beam 21 can have only one end stretching into the corresponding hole structure 10, and the two corresponding beams 21 of the two adjacent hook portions 100 can be integrally connected to each other, so as to form an integral structure.

In order for easy manufacture/production, as shown in FIG. 1B, each hook structure 2 is a conical column and includes a first end, e.g., an upper end, and a second end, e.g. a lower end. A diameter of each hook structure 2 gradually decreases from the second end of each hook structure 2 toward the first end of each hook structure 2. A longitudinal direction of each hook structure 2 is substantially perpendicular to the strap body 1. The second end of each hook structure 2 is connected to the hole wall of the corresponding hole structure 10, e.g., by the corresponding beam 21, and located adjacent to the second surface 1*b* of the strap body 1 and away from the first surface 1*a* of the strap body 1, and the first end of each hook structure 2 is located adjacent to the first surface 1*a* of the strap body 1 and away from the second surface 1*b* of the strap body 1.

As shown in FIG. 1A and FIG. 3D, a length or a height of each hook structure 2 is less than a thickness of the strap body 1, such that each hook structure 2 does not protrude out of the corresponding hole structure 10 beyond the first surface 1*a* of the strap body 1. Therefore, it prevents increase of an overall thickness of the strap member 1000.

Specifically, as shown in FIG. 1A and FIG. 3A, the hole structures 10 are in a column staggered arrangement, i.e., the hole structures 10 aligned in two adjacent columns are offset from each other.

More specifically, each hole structure 10 can be a circular hole structure for easy manufacture/production. Each hook portion 100 can include six hook structures 2. As shown in FIG. 3E, the six hook structures 2 can be arranged symmetrically relative to a center of the corresponding hole structure 10. Besides, as shown in FIG. 3F, each hook portion 100 can include six beams 21 radially arranged relative to the center of the corresponding hole structure 10. Each of six hook structures 2 can be formed on an end of the corresponding beam 21 stretching into the corresponding hole structure 10, and an included angle between the two adjacent beams 21 of each hook portion 100 can be 60 degrees.

Preferably, the strap body 1 can be a soft or flexible strap-shaped structure.

Preferably, the strap member 1000 can be made of a plastic material and through an insert-molding process.

The strap member 1000 of this embodiment can be configured to cooperate with a cooperating strap member 3000. The strap member 1000 and the cooperating strap member 3000 can form a strap assembly suitable for being attached on a cloth, a bag, a shoe or the like by sewing.

Figure 3G:
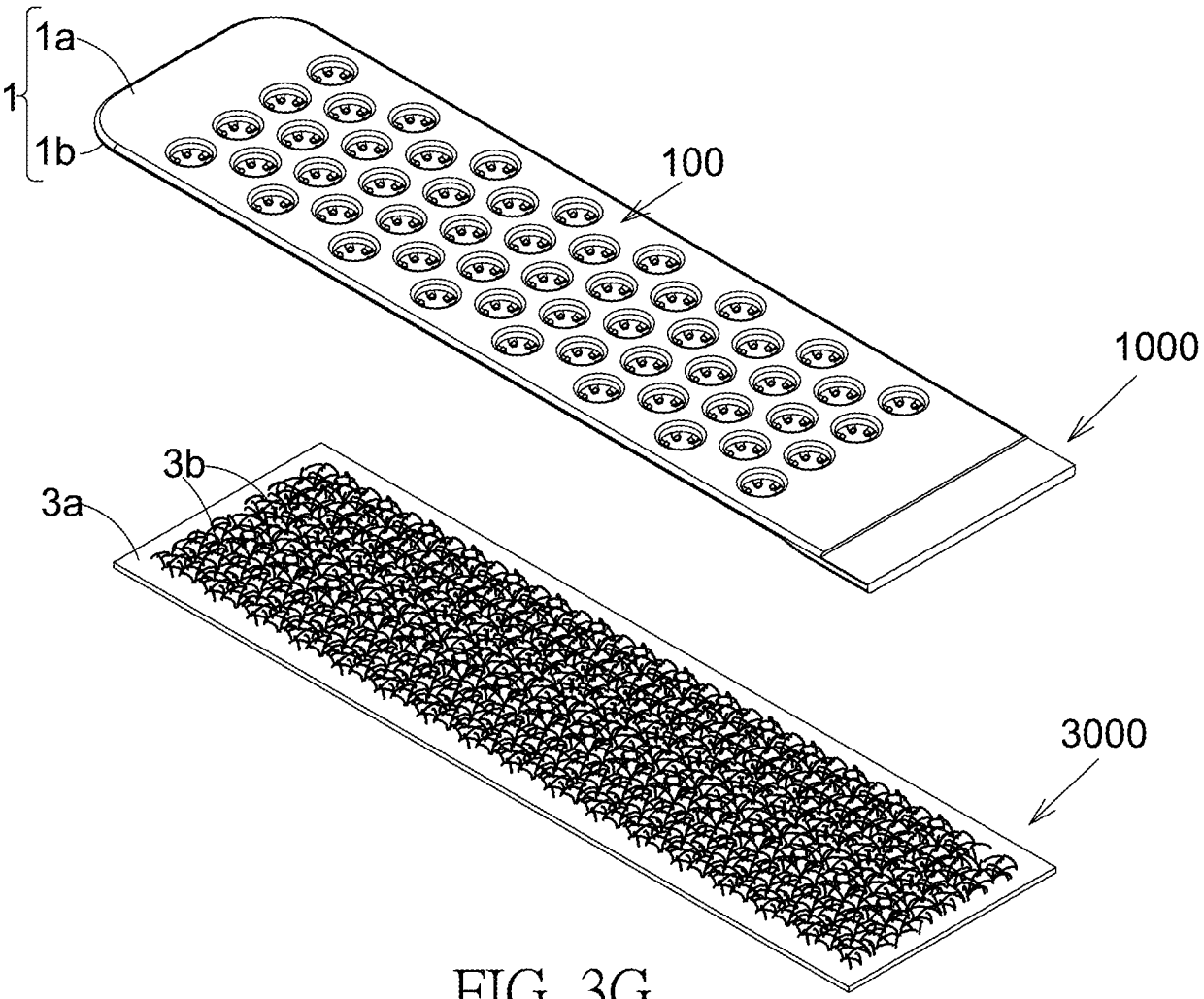
FIG. 3G is a diagram illustrating the strap member and a cooperating strap member according to the first embodiment of the present invention.
Figure 3H:
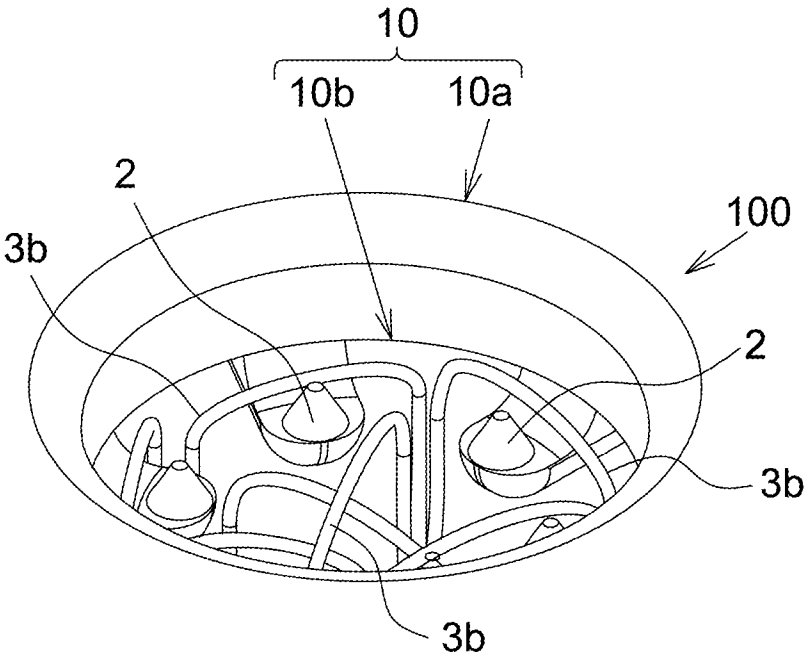
FIG. 3H is a diagram illustrating the hook portion of the strap member engages with loop structures of the cooperating strap member according to the first embodiment of the present invention.

Specifically, as shown in FIG. 3G and FIG. 3H, the cooperating strap member 3000 can be used as a female strap member, and the strap member 1000 can be used as a male strap member. The cooperating strap member 3000 includes a cooperating surface 3*a* and a plurality of loop structures 3*b* disposed on the cooperating surface 3*a* and configured to detachably engage with the hook structures 2 of the plurality of hook portions 100 through the second openings 10*b* to bind the second surface 1*b* of the strap body 1 and the cooperating surface 3*a* of the cooperating strap member 3000 together.

Besides, as shown in FIG. 4A to FIG. 6D, different from the first embodiment, in a second embodiment, each hook portion 100 further includes an island structure 3 and at least one connecting rib 220.

Figure 4A:
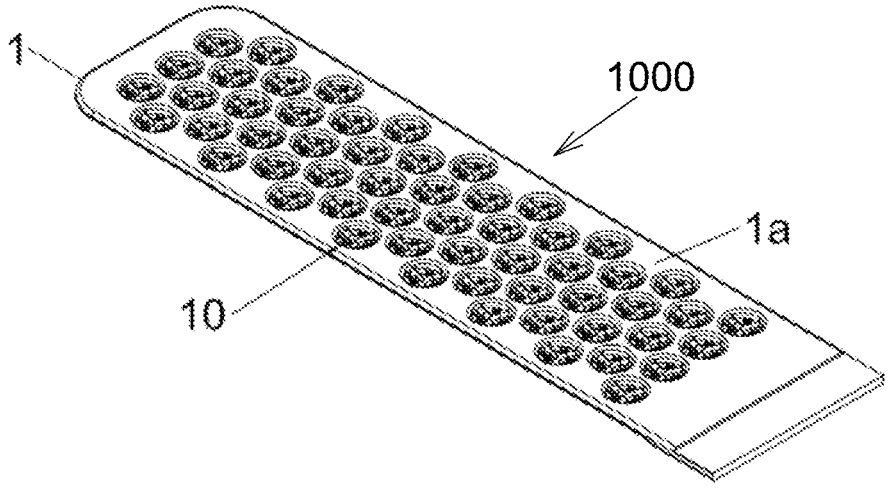
FIG. 4A is a perspective diagram of a strap member according to a second embodiment of the present invention.
Figure 4B:
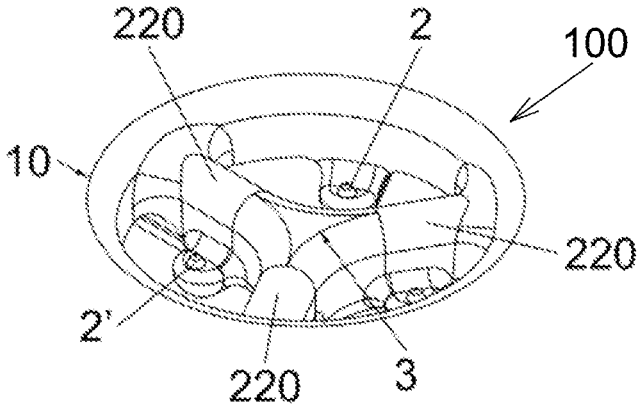
FIG. 4B is a diagram of a hook portion of the strap member shown in FIG. 4A according to the second embodiment of the present invention.
Figure 5:
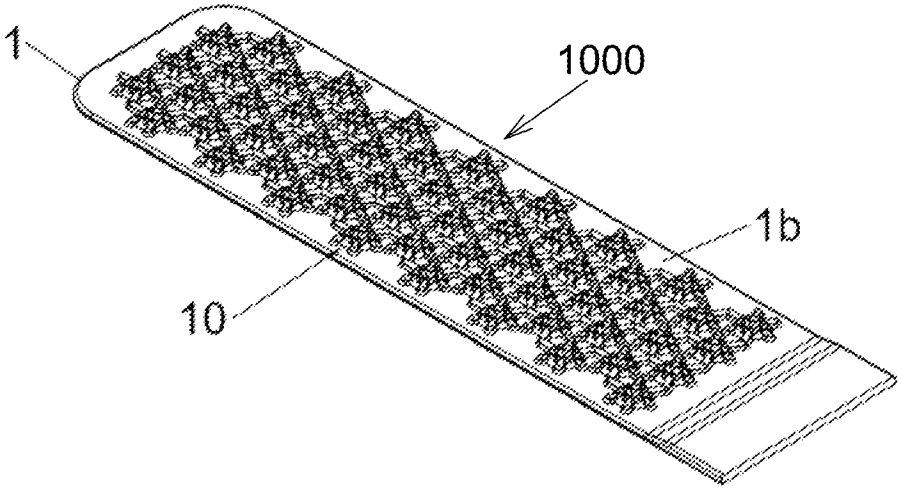
FIG. 5 is another perspective diagram of the strap member according to the second embodiment of the present invention.
Figure 6A:
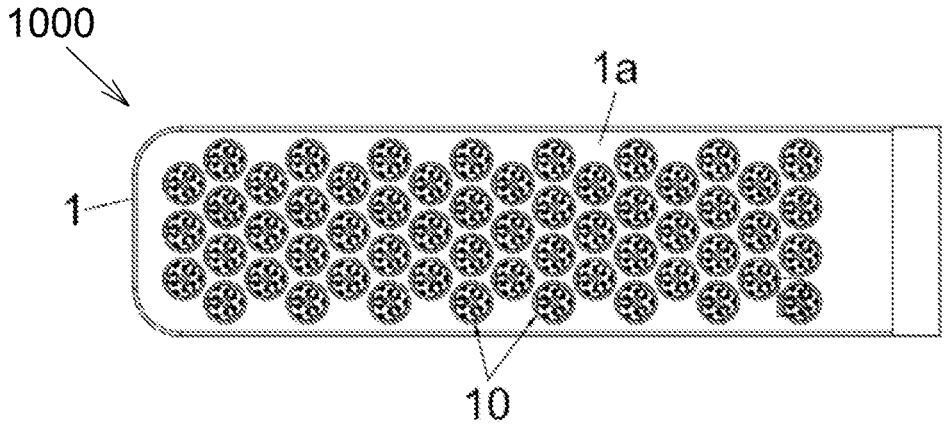
FIG. 6A and FIG. 6B are diagrams of the strap member at different views according to the second embodiment of the present invention.
Figure 6B:
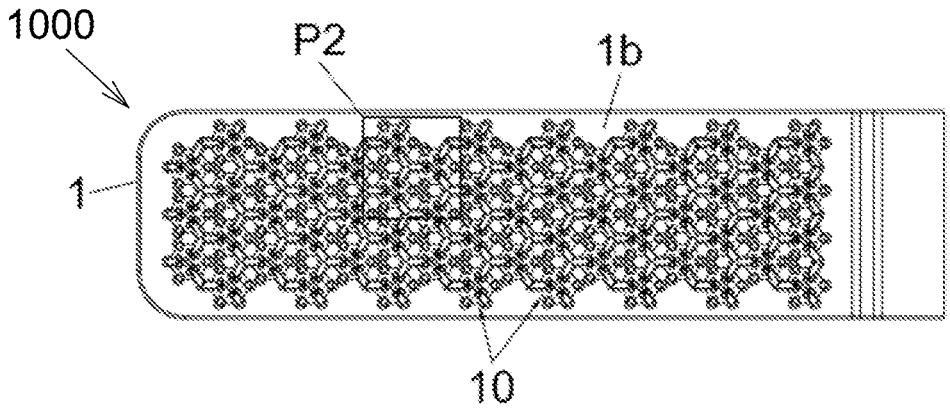
Figure 6C:
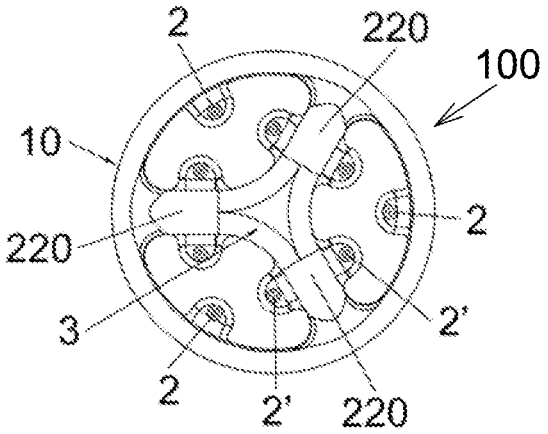
FIG. 6C is a diagram of the hook portion of the strap member shown in FIG. 6A according to the second embodiment of the present invention.
Figure 6D:
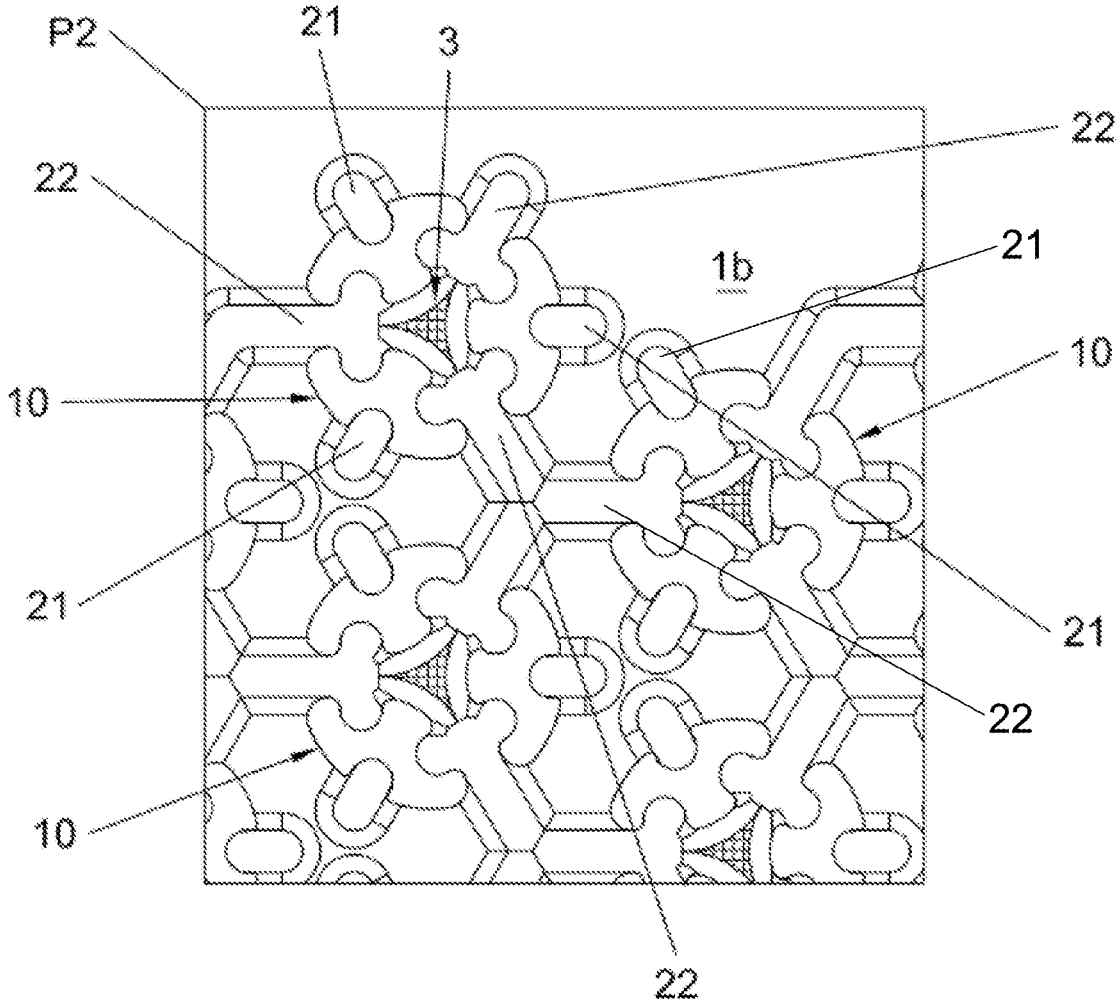
FIG. 6D is an enlarged diagram of a P2 portion of the strap member shown in FIG. 6B according to the second embodiment of the present invention.

As shown in FIG. 4B, FIG. 6C and FIG. 6D, each island structure 3 is disposed on a middle part of the corresponding hole structure 10, and each connecting rib 220 is connected to the corresponding island structure 3 and the hole wall of the corresponding hole structure 10, i.e., each island structure 3 is connected to the hole wall of the corresponding hole structure 10 by the corresponding connecting rib 220.

Preferably, in the second embodiment, as shown in FIG. 4B and FIG. 6C, each hook portion 100 can further include at least one auxiliary hook structure 2' formed on the at least one connecting rib 200 for enhancing a bonding strength of the first surface 1*a* of the strap body 1 and the cooperating surface of the cooperating strap member.

Besides, in the second embodiment, as shown in FIG. 6B and FIG. 6D, each hook portion 100 further includes at least one auxiliary beam 22 disposed on the second surface 1*b* of the strap body 1 and extending along the second surface 1*b* of the strap body 1. In other words, a longitudinal direction of each auxiliary beam 22 is substantially parallel to the second surface 1*b* of the strap body 1, and a distal beam surface of each auxiliary beam 22 is connected to the second surface 1*b* of the strap body 1.

Specifically, as shown in FIG. 6C and FIG. 6D, at least one end of each auxiliary beam 22 stretches into the corresponding hole structure 10, and each connecting rib 220 is formed on the corresponding end of the corresponding auxiliary beam 22.

As shown in FIG. 6D, each auxiliary beam 22 can have only one end stretching into the corresponding hole structure 10, and the corresponding auxiliary beams 22 of adjacent two of the plurality of hook portions 100 can be integrally connected to each other.

Furthermore, as shown in FIG. 6D, in the second embodiment, each beam 21 can have only one end stretching into the corresponding hole structure 10, and the corresponding beams 21 of adjacent two of the plurality of hook portions 100 can be separated from each other.

More specifically, as shown in FIG. 6C and FIG. 6D, in the second embodiment, each hole structure 10 can be a circular hole structure. The island structure 3 can be a substantially triangular structure. Each hook portion 100 can include three auxiliary beams 22 and three connecting ribs 220 formed on the three auxiliary beams 22 respectively and connected to three peak portions of the island structure 3 respectively and the hole wall of the corresponding hole structure 10. Each hook portion 100 can include six auxiliary hook structures 2' arranged symmetrically relative to the center of the corresponding hole structure 10, and every two of the six auxiliary hook structures 2' are symmetrically formed on two sides of each connecting rib 220. Moreover, each hook portion 100 can include three hook structures 2 arranged symmetrically relative to the center of the corresponding hole structure 10, and three beams 21 radially arranged relative to the center of the corresponding hole structure 10. Each of three hook structures 2 can be formed on an end of the corresponding beam 21 stretching into the corresponding hole structure 10, and an included angle between the two adjacent beams 21 of each hook portion 100 can be 120 degrees.

Other details of this embodiment are identical to the one of the first embodiment. Detailed description is omitted herein for simplicity.

The strap member of the second embodiment also can be configured to cooperate with the cooperating strap member, so as to cooperatively form another strap assembly suitable for being attached on a cloth, a bag, a shoe or the like by sewing.

Understandably, the present invention is not limited to the aforementioned embodiments, and there can be various embodiments. For example, in another embodiment, the auxiliary hook can be formed on the island structure. In another embodiment, the beam can be omitted, i.e., there can be only auxiliary beams on the second surface of the strap body. In another embodiment, the hole structure can be a rectangular hole structure, a triangular hole structure, a hexagonal hole structure, an elliptical hole structure, or any other irregular-shaped hole structure. In another embodiment, the hook structures or the auxiliary hook structures can be in an axially symmetrical arrangement or in an asymmetrical arrangement. In another embodiment, there can be only one hook structure and/or one auxiliary hook structure.

In contrast to the prior art, in the present invention, the hook structure does not protrude out of the hole structure penetrating through the strap body beyond the first surface of the strap body, and therefore, the strap member has a thin thickness and is suitable for being attached on a cloth, a bag or a shoe by sewing.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A strap member comprising:

a strap body comprising a first surface and a second surface; and a plurality of hook portions, each of the plurality of hook portions comprising:

a hole structure penetrating through the strap body and comprising a first opening formed on the first surface and a second opening formed on the second surface; and at least one hook structure at least partially disposed inside the hole structure and connected to a hole wall of the hole structure, the at least one hook structure not protruding out of the hole structure beyond the first surface of the strap body, wherein the at least one hook structure is a conical column and comprises a first end and a second end, a diameter of the at least one hook structure gradually decreases from the second end of the at least one hook structure toward the first end of the at least one hook structure, a longitudinal direction of the at least one hook structure is perpendicular to the strap body, the second end of the at least one hook structure is connected to the hole wall, and the first end of the at least one hook structure is located adjacent to the first surface of the strap body;

at least one beam disposed on the second surface of the strap body and extending along the second surface of the strap body, at least one end of the at least one beam stretching into the hole structure, the at least one hook structure being formed on the at least one end of the at least one beam, and an extending direction of the at least one beam being parallel to the second surface of the strap body.

2. The strap member of claim 1, wherein the hole structure is a circular hole structure.

3. The strap member of claim 1, wherein the at least one hook structure comprises a plurality of hook structures arranged symmetrically relative to a center of the hole structure.

4. A strap assembly comprising:

a strap member comprising:

a strap body comprising a first surface and a second surface; and a plurality of hook portions, each of the plurality of hook portions comprising:

a hole structure penetrating through the strap body and comprising a first opening formed on the first surface and a second opening formed on the second surface; and at least one hook structure at least partially disposed inside the hole structure and connected to a hole wall of the hole structure, the at least one hook structure not protruding out of the hole structure beyond the first surface of the strap body, wherein the at least one hook structure is a conical column and comprises a first end and a second end, a diameter of the at least one hook structure gradually decreases from the second end of the at least one hook structure toward the first end of the at least one hook structure, a longitudinal direction of the at least one hook structure is perpendicular to the strap body, the second end of the at least one hook structure is connected to the hole wall, and the first end of the at least one hook structure is located adjacent to the first surface of the strap body;

at least one beam disposed on the second surface of the strap body and extending along the second surface of the strap body, at least one end of the at least one beam stretching into the hole structure, the at least one hook structure being formed on the at least one end of the at least one beam, and an extending direction of the at least one beam being parallel to the second surface of the strap body; and a cooperating strap member comprising:

a cooperating surface; and a plurality of loop structures disposed on the cooperating surface and configured to detachably engage with the hook structures of the plurality of hook portions through the second openings to bind the second surface of the strap body and the cooperating surface of the cooperating strap member together.

5. The strap assembly of claim 4, wherein the hole structure is a circular hole structure.

6. The strap assembly of claim 4, wherein the at least one hook structure comprises a plurality of hook structures arranged symmetrically relative to a center of the hole structure.

* * * * *